United States Patent [19]

Symmank

[11] Patent Number: 4,722,461

[45] Date of Patent: Feb. 2, 1988

[54] PRESSURE RELIEF LIQUID SPRAY DISPENSER APPARATUS

[76] Inventor: William D. Symmank, P.O. Box 1570, Jasper, Tex. 75951

[21] Appl. No.: 592,419

[22] Filed: Mar. 23, 1984

[51] Int. Cl.[4] ..... B67D 5/06

[52] U.S. Cl. ..... 222/181; 222/185; 222/397; 222/402.15; 222/509

[58] Field of Search ..... 222/181, 180, 185, 396, 222/397, 402.15, 153, 509; 74/99 R; 474/135, 26

[56] References Cited

U.S. PATENT DOCUMENTS

| | | | |
|---|---|---|---|
| 3,659,755 | 5/1972 | Prussin et al. | 222/397 |
| 3,784,064 | 1/1974 | Hardt | 222/397 |
| 3,809,319 | 5/1974 | Kimura | 222/180 |
| 4,068,575 | 1/1978 | Difley et al. | 222/180 X |
| 4,111,338 | 9/1978 | Cheng et al. | 222/180 |

*Primary Examiner*—Joseph J. Rolla
*Assistant Examiner*—David H. Bollinger
*Attorney, Agent, or Firm*—Kenneth D. Baugh

[57] ABSTRACT

A pressure relief liquid spray dispenser apparatus 10 is provided that allows a gas charged liquid spray dispenser 24 to be utilized in high temperature environments. The liquid spray dispenser apparatus 10 includes a supporting bracket 12 ) which receives a gas charged dispenser 24. The dispenser 24, having a domed shaped valve end 98 is positioned in an aperture 14 in the supporting bracket 12 so that a valve 27 on the head 98 is positioned adjacent to a control arm 50. The control arm 50 can be pivoted in the direction of the dispenser 24 to engage the valve 27 thereby releasing spray in the dispenser. The domed shaped valve end 98 of the dispenser 24 has a bellows like construction. The valve end 98 unfolds longitudinally outward when subject to excessive pressures from the expansion of the gas in the dispenser 24 at high temperatures. When this occurs the dispenser valve 27 engages the control arm 50 pivoting it away from the dispenser 24 and releasing spray in the dispenser.

9 Claims, 7 Drawing Figures

PRESSURE RELIEF LIQUID SPRAY DISPENSER APPARATUS

TECHNICAL FIELD

This invention relates to a means for using conventional liquid spray type dispensers at temperatures higher than the normal temperature. In typical uses of spray dispensers the dispensers are usually hand held and employed at approximately 70 degrees F.

In some operations however, it may be desirable to use a spray dispenser in temperatures that are higher than normal. A typical use would be in applying liquid spray lubricants to open gear drives on construction equipment such as power shovels, cranes excavators and the like. An example would be a turntable bearing ring gear assembly of the type which is usually mounted deep into the upper structure of a machine such as, for example, a crane. Due to numerous function controls and systems that must be located within an open area of the turntable bearing, the access location to the gears is not normally found near the operator's compartment. The access location is usually remote from the operator and exposes only a few gear teeth when the turntable is stationary. Thus one person is required to rotate the turntable while a second person manually applies a lubricant of some type to the gears. This of course, makes the lubricating process inconvenient and complicated.

The most widely used method to accomplish this lubricating process is the liquid spray dispenser. The spray dispenser is hand held and limited to temperatures up to 120° F. which is less than normally found near engine power plants and heat generating systems such as, for example, the crane.

The liquid spray material in a liquid spray dispensing system is usually propelled by a compressed gas such as $CO_2$ or liquifiable gases commonly known as the aerosol system. Such gas propellants have a high rate of thermal expansion of which increases the precharged pressure with increased temperatures. Uncontrolled pressures resulting from increased temperatures will tend to explode the dispenser thereby creating a dangerous flying object condition.

It is desirable then to provide a liquid spray dispensing system which need not be hand held and which can be safely used in higher than normal temperatures.

It is also desirable to provide a dispensing system which will automatically discharge a standard dispenser and release the contents of the liquid spray dispenser at less than the temperature related burst pressure of the dispenser.

BACKGROUND ART

Attempts have been made to provide means for discharging pressurized containers when the internal pressure exceeds predetermined limits because of increased temperatures. One such arrangement is a system including a plurality of scores formed in the dispenser body which fracture the dispenser when it buckles because of increased temperatures. A system such as this is disclosed in U.S. Pat. No. 3,680,743. Another arrangement of this nature is disclosed in U.S. Pat. No. 3,786,967. U.S. Pat. No. 3,074,602 discloses another arrangement employing a dispenser having a sensitive area or weak spot formed therein. This area of the dispenser will rupture when exposed to excessive temperatures.

Although these devices attempt to assure that the dispenser is discharged of its contents when exposed to excessive pressure they do not employ the standard conventional dispenser. They all require specially manufactured dispensers.

DISCLOSURE OF INVENTION

The invention relates to a pressure relief liquid spray dispenser apparatus. The liquid spray dispenser apparatus in accordance with the present invention includes a spray dispenser. The spray dispenser includes a valve formed thereon which releases a liquid spray material from the dispenser. A means is provided, having a recessed opening formed therein, for supporting the spray dispenser. A retention means is provided for fixedly positioning the spray dispenser in the recessed opening in the supporting means. This allows unobstructed longitudinal expansion movement of portions of the spray dispenser through the recessed opening in the supporting means. The spray dispenser apparatus also includes an actuating means for selectively activating the dispenser valve. This permits an unobstructed flow of liquid spray material from the dispenser when the actuating means is moved to engage the valve and when portions of the dispenser move longitudinally to cause the valve to engage the actuating means.

BRIEF DESCRIPTION OF DRAWING

The details of the invention will be described in connection with the accompanying drawing in which.

BEST MODE OF CARRY OUT THE INVENTION

Figure 1:
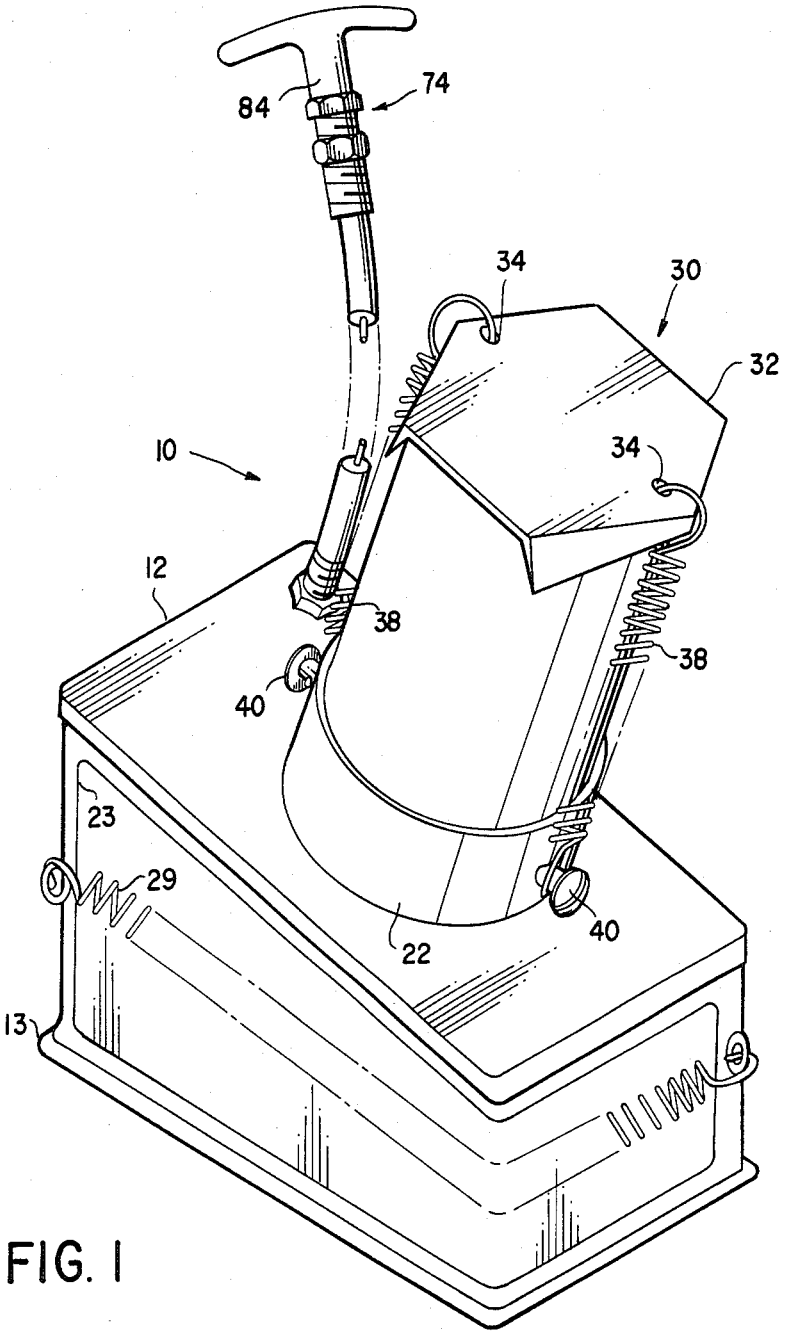
FIG. 1 is a perspective view illustrating the preferred embodiment of the pressure relief spray dispenser apparatus.
Figure 2:
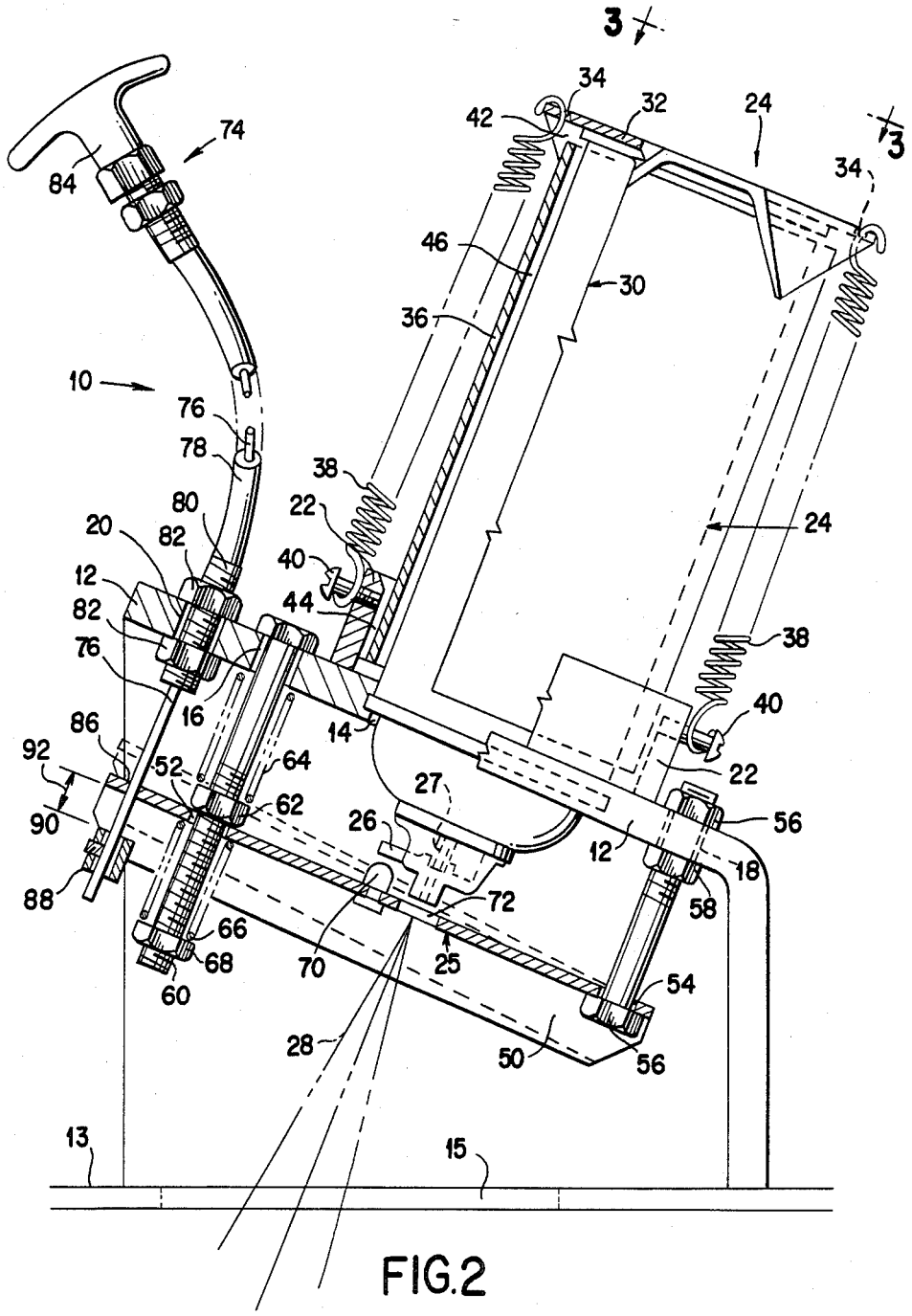
FIG. 2 is a broken-out sectional view of FIG. 1 showing the spray dispenser apparatus in the relaxed non spray position and the spray position.

Referring to FIGS. 1 and 2, a pressure relief liquid spray dispenser apparatus 10 is shown including a supporting bracket 12. The supporting bracket 12 includes a recessed opening 14 and apertures 16, 18 and 20 formed therein. The supporting bracket 12 also includes a base member 13 having an opening 15 formed therein. Additionally the supporting bracket 12 includes a guide tube 22 formed thereon. A removable access plate 23 is provided and held in place by a spring 29. The supporting bracket 12 may be formed, for example, of a light weight metal.

The recessed opening 14 is provided to receive a dispenser generally designated as 24. The dispenser 24 includes a plastic valve spray nozzle assembly generally designated by the numeral 25 having a tab 26 and valve 27. When moved inwardly the nozzle 25 opens the valve 27. This allows compressed gas to force liquid material out of the dispenser 24 to form a spray 28.

The liquid spray dispenser apparatus 10 also includes an enclosure 30. The enclosure 30 provides a protective cover around the spray dispenser 24 to retain flying objects if the dispenser ruptures. The enclosure 30 includes an end cap 32 having spaced openings 34 formed therethrough and a protector tube 36. The enclosure 30 may also be formed for example of a light weight metal.

Tension members or springs 38 are secured to the end cap 32 in openings 34 at one end thereof. The other end of the springs 38 are coupled to a screw 40 mounted on the guide tube 22. This arrangement secures the enclosure 30 to the supporting bracket 12 and provides means for retention of the dispenser. The enclosure 30 has dimensions slightly larger than that of the liquid spray dispenser 24. These dimension differences allow the formation of channels 42, 44, and 46 which allow pressurized gas to escape easily, in case of a rupture of the dispenser.

The liquid spray dispenser apparatus 10 also includes an actuating control arm 50 having apertures 52 and 54 formed therein. The control arm 50 is pivotably connected to the supporting bracket 12. A bolt 56 is provided and extends through aperture 54 in the control arm 50 and aperture 18 in the supporting bracket 12 to couple one end of the control arm to the supporting bracket. Lock nuts 58 secure the bolt 56 to the supporting bracket 12. The other end of the the control arm 50 includes a bolt 60 which passes through the aperture 16 in the supporting bracket 12 and through aperture 52 in the control arm. Lock nut 62 and compression spring 64 are positioned on the bolt 60 between the control arm 50 and supporting bracket 12. A second compression spring 66 is positioned on the bolt 60 in the aperture 52 in the control arm 50. The compression spring 66 is secured in the aperture 52 by a lock nut 68. This arrangement provides a desired positioning of the control arm 50 with respect to the dispenser spray nozzle 25. When the control arm 50 is in this position it is considered to be in a relaxed non-spray postion. The control arm 50 can only be moved from the non-spray position by the application of a predetermined force which overcomes the resistive force of the compression springs 64 or 66.

A projection 70 is provided on the control arm 50. The projection 70 is aligned to engage the tab 26 of the spray nozzle 25 and activate the spray dispenser valve 27. An opening 72 in the control arm 50 is provided to allow an unobstructed flow of a liquid spray material 28 through the aperture 15 in the supporting bracket 12.

Figure 6:
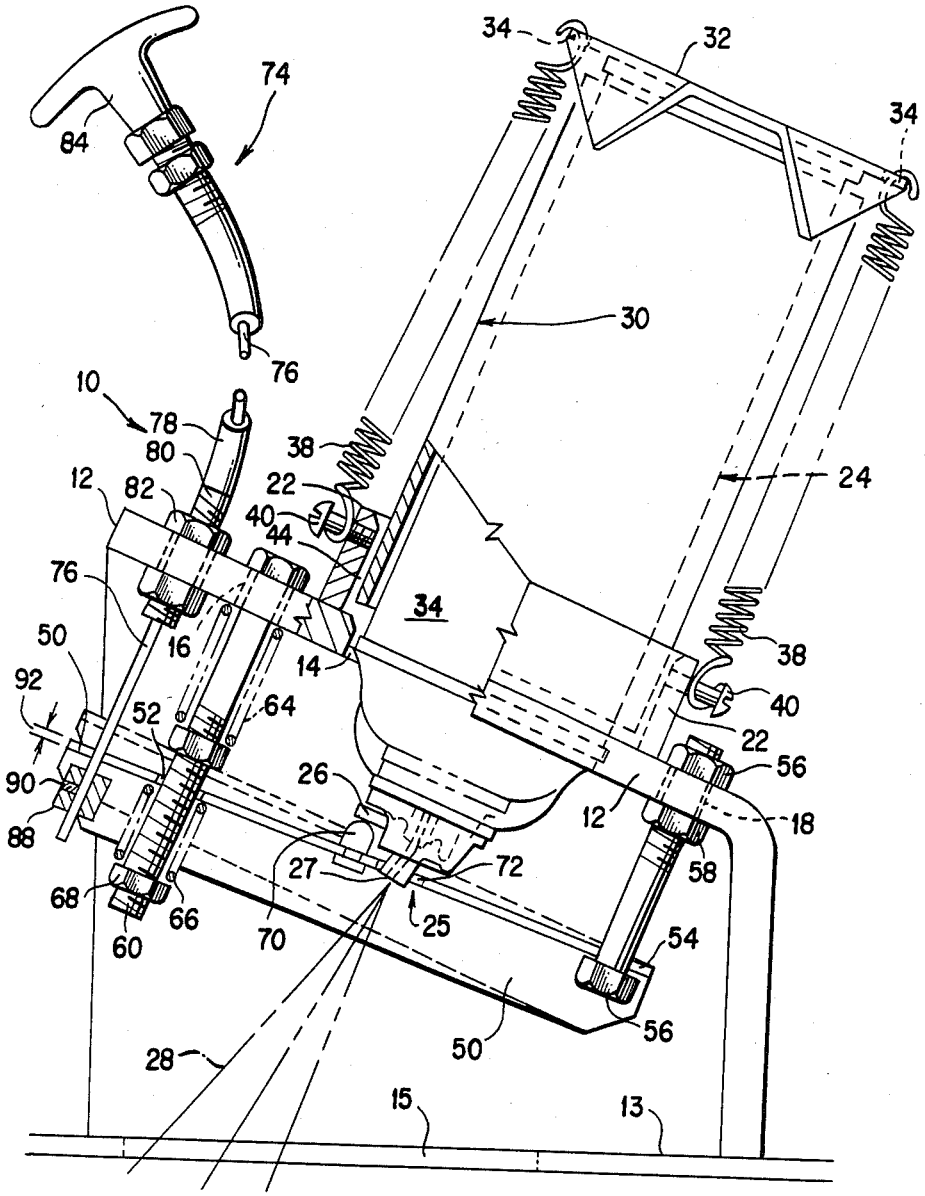
FIG. 6 is another broken-out sectional view of FIG. 1 showing the spray dispenser apparatus in the pressure relief spray position.

A pull cable apparatus or remote actuating member 74 having a cable 76 formed therein is provided to actuate the control arm 50. The cable 76 is encased in a protective cover 78. The protective cover 78 includes a threaded mounting means 80 secured in an opening 20 to the support bracket 12 by locking nuts 82. The pull cable apparatus 74 is provided with a handle 84 coupled to one end of the cable 76. The other end of the cable 76 is attached to control arm 50 through an opening 86 formed therein, by a positioning collar 88 and set screw 90. A space 92 between positioning collar 88 and control arm 50 is provided to prevent overloading of the system when in a pressure relief condition (FIG. 6). Other means of remote control energy such as, for example electric, could be used to selectively actuate the control arm 50.

When it is desired to activate the spray dispenser apparatus 10 a pull force is applied to the cable 76. This force moves collar 88 to contact the control arm 50. The force will also compress the spring 64 and move the control arm 50 (illustrated in phantom in FIG. 2) in the direction of the spray dispenser 24. As a result the projection 70 of the control arm 50 will engage the tab 26 of the spray nozzle 25 thereby activating the dispenser valve 27 and releasing spray material 28.

The collar 88 being attached to the pull cable 76 on only one side of the control arm 50 allows free movement of the control arm 50 independently of cable 76. Thus the control arm 50 can be moved to activate the spray dispenser 24 independently of the pull cable apparatus or remote actuating member 74.

Figure 3:
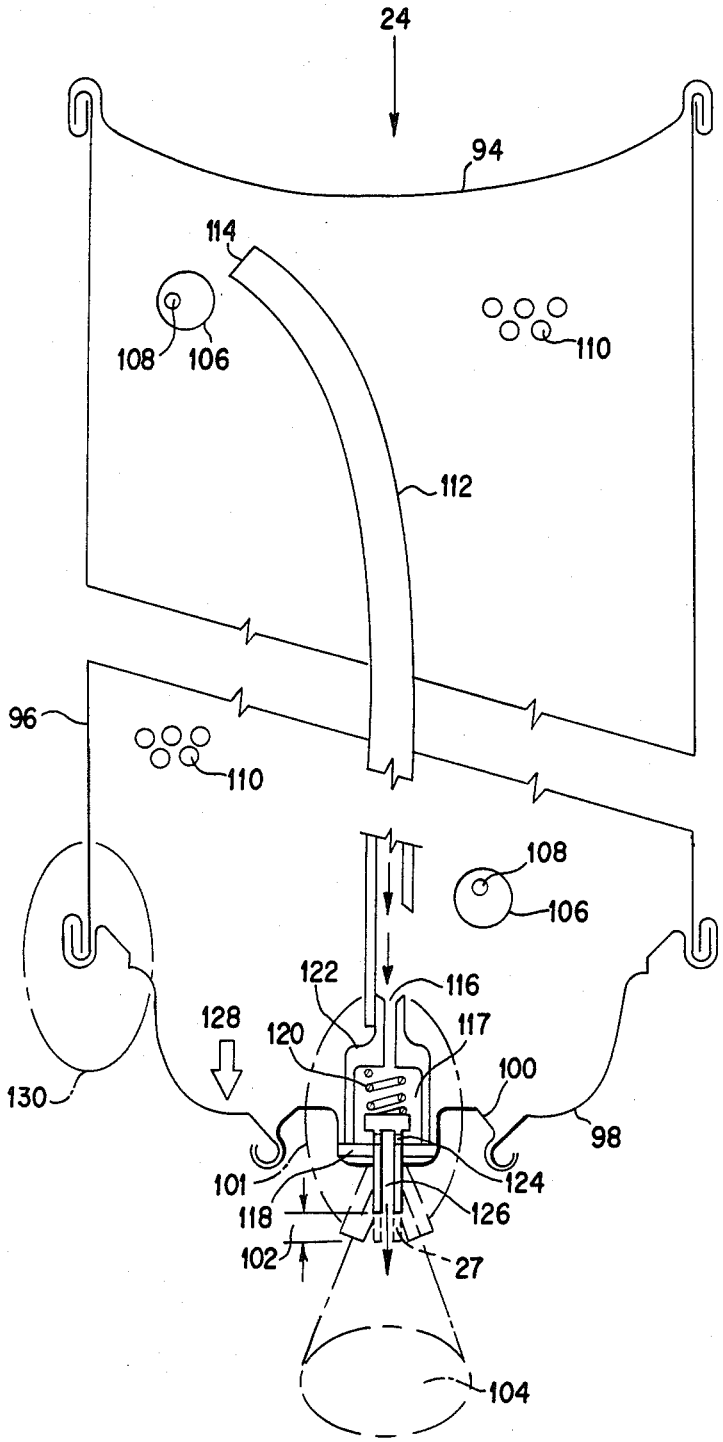
FIG. 3 is an enlarged cross-sectional view taken at 3—3 in FIG. 1 showing the spray dispenser only.

Another characteristic of the spray dispenser apparatus 10 maybe understood with reference to FIG. 3. FIG. 3 illustrates details of the spray dispenser 24. The spray dispenser 24 is formed of a concaved blind head 94, a body 96, a dome valve end head 98, the valve retainer head 100 and the valve system 101 having a valve 27. The valve 27 may, for example, have an actuating motion inwardly as illustrated at 102 or radially as illustrated at 104 or any combination of the two motions.

Many types of compressed gases are used as propellants in liquid spray dispensers, the most common of which is a liquified type known as the aerosol system. The aerosol system is preferred due to its ability to retain a precharged pressure by transforming from a liquid to a gas as the volume of an application material, is being reduced.

FIG. 3 also illustrates the aerosol system as disclosed in this invention. An application material 106 is mixed in solution with a liquified gas 108. Some of the liquified gas comes out of solution and forms a gas pressure 110. This gas pressure 110 provides the propelling means to discharge the volume of the application material 106. The discharging of the volume of application material 106 tends to reduce the gas pressure 110 allowing more liquified gas 108 to come out of solution and maintain the gas pressure 110. Some of the liquified gas 108 remains in solution and is discharged along with the material 106 through a tube 112 at an end 114 thereof. This occurs by maintaining a gas pressure 110 on top of the liquified gas 108 and application material 106 for vertical upwardly discharging. The omission of tube 112 allows the application material 106 and liquified gas 108 to enter opening 116 in the valve body 122 by maintaining a gas pressure 110 on top of the application material and liquified gas for vertical downwardly discharging.

When the valve stem 27 is moved inwardly away from seal 118 by compressing spring 120 the valve is in the discharging position. The application material 106 and liquefied gas 108 pass through opening 116 and 117 of the valve body 122. The application material and liquified gas 108 then pass through opening 124 and 126 of the valve stem 27 and is discharged through the spray nozzle 25 as shown in FIG. 2. Since the liquified gas 108 is being discharged to the lower atmosphere the liquid spray effect is achieved.

The gas 110 will expand when subjected to increased temperatures and will result in pressures higher than the original precharge pressure of the dispenser 24. This pressure results in a force 128 on the valve end head 98. This causes the valve end head 98 to move longitudially outward due to its bellows construction illustrated at 130. This effect is more clearly shown in FIGS. 4 and 5.

Figure 4:
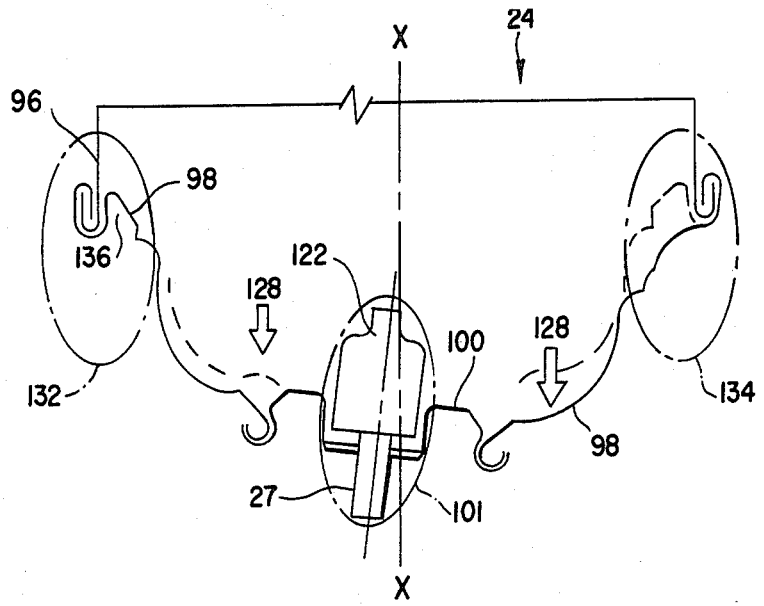
FIG. 4 is an enlarged broken-out sectional view of the dispenser valve end head in FIG. 2 showing the valve end head partially expanded.

As illustrated in FIG. 4 the valve end head 98 is in the process of being unfolded due to high internal pressure. As can be seen the bellows configuration illustrated at 132 is being extruded to a more uniform dome configuration as illustrated at 134. The space 136 is necessary for conventional flanging and crimping equipment to provide a tight seal joint between the tube 96 and head 98. The profile change from the point illustrated at 132 to 134 usually occurs one side at a time. As can be seen the complete valve system 101 will remain with the valve retainer head 100 thereby repositioning the valve system outward longitudinally and radially.

Figure 5:
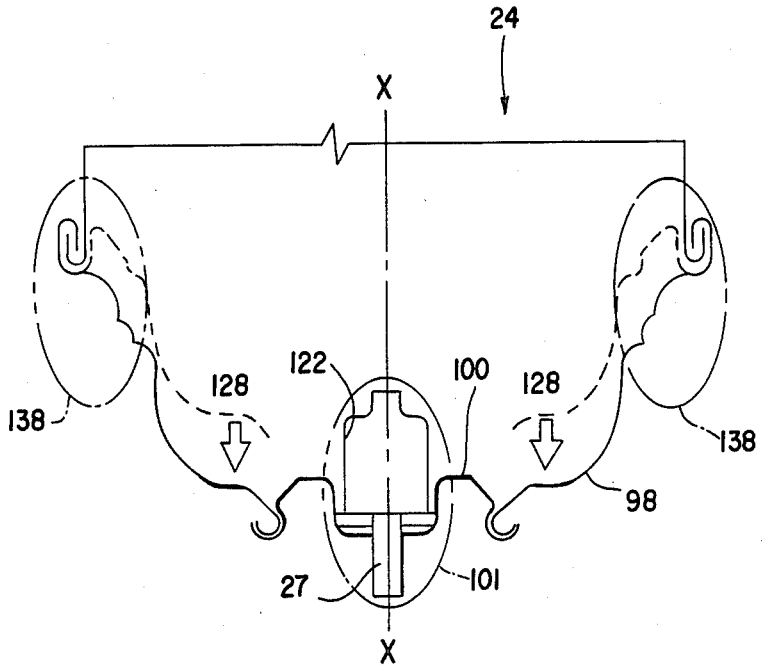
FIG. 5 is the enlarged broken-out sectional view of FIG. 4 with the valve end head fully expanded.

In FIG. 5 the valve end head 98 is shown with the unfolding process of the bellows construction having been circumferentially completed as illustrated at 138. The pressure at which the unfolding will occur is controlled by existing standards established for manufacturing quality control in the gas charged liquid dispenser industry. It can be seen that the valve system 101 with its valve 27 has returned to a longitudinal axis X—X and is positioned further outwardly.

Referring to FIG. 6 the spray dispenser apparatus 10 is shown in the automatic pressure relief spray position. As previously disclosed in FIG. 2 the dispenser 24 is retained in opening 14 by springs 38. The dome valve end head 98 and the tab type spray nozzle 25 have been moved longitudinally outward resulting from the pressure related unfolding of the bellows effect as shown at 138 in FIG. 5. To prevent overloading of the valve system 101 from forces created by engagement of the tab 26 and the projection 70 the compression spring 66 will deflect at a predetermined force. This allows the control arm 50 to move outwardly with the spray nozzle 25. When the dispenser valve 27 has been moved into contact with the projection 70 of the control arm 50 and deflection occurs the spray material 28 is released. The space 92 allows movement of the control arm 50 independent of the cable 76 when in the automatic pressure relief position.

Figure 7:
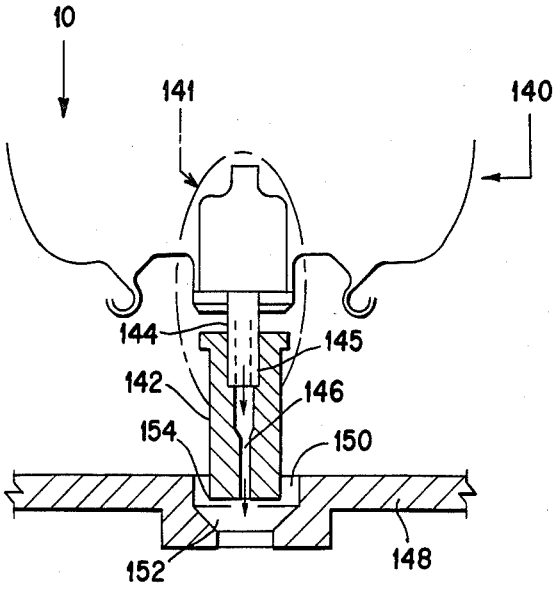
FIG. 7 is a partial view of portions of a second embodiment of the spray dispenser apparatus.

FIG. 7 is a partial view illustrating portions of a second embodiment of the spray dispenser apparatus 10. This embodiment includes a dispenser 140 having a different valve system 141. The valve system 141 includes a cylindrical body nozzle 142 which is attached to a valve 144 at an opening 145. When the valve 144 is moved inwardly or radially a liquid spray will be discharged through opening 146.

A control arm 148 is provided having an opening 150. The opening 150 includes recessed portions 152. The recessed portions 152 of the opening 150 cooperate with end 154 of the cylindrical body 142 to activate the valve 144. The other components of the control arm 148 are the same as control arm 50 illustrated in FIG. 2. Simularly other portions of the spray dispenser apparatus 10 (FIG. 2) are the same.

The cylindrical body 142 is positioned inside the opening 150 in the control arm 148. The valve system 141 will move to engage the control arm 148 when unfolding occurs (FIG. 5) resulting in an inward movement of the valve 144. This activates the valve system 141 and thereby providing an automatic pressure relief system.

When the control arm 148 is moved in the direction of the valve 144 the recessed portions 152 of the opening 150 will contact the end 154 of the cylindrical body 142. This move the valve 144 inwardly, activating the valve stem system 141 and releasing the liquid spray.

It should be understood that various changes and modificatons can be made without departing from the spririt of the invention as defined in the following claims.

What is claimed is:

1. A liquid spray dispenser apparatus comprising:

a spray dispenser having a valve formed thereon, for discharging a liquid spray material;

means, having a recessed opening formed therein, for supporting the spray dispenser;

a retention means for positioning the spray dispenser in the recessed opening in the supporting means and for allowing unobstructed longitudinal expansion movement of portions of the spray dispenser through the recessed opening in the supporting means;

a control arm;

means for pivotably coupling the control arm at one end thereof to a corresponding portion of the supporting means;

a first compression spring positioned between the other end of the control arm and the supporting means;

a second compression spring positioned on the control arm in alignment with and adjacent to the first compression spring; and a bolt extending through the first and second compression springs to couple the first and second compression springs to the supporting means and the control arm in a normally neutral position so that upon the application of a predetermined force to the control arm, the dispenser is activated to allow an unobstructed flow of liquid spray material from the dispenser when the control arm is moved inwardly toward the supporting means to engage the dispenser valve or when portions of the dispenser move outwardly from the supporting means causing the dispenser valve to engage the control arm.

2. The liquid spray dispenser apparatus as defined in claim 1 wherein the control arm coupling means includes a bolt extending through the control arm and the supporting means.

3. The liquid spray dispenser apparatus as defined in claim 2 wherein the dispenser includes a first portion which moves longitudinally outwardly when subjected to pressures that exceed a predetermined pressure thereby causing the valve to move into engagement with the control arm and release the liquid spray material from the dispenser.

4. The liquid spray dispenser apparatus as defined in claim 3 wherein the dispenser includes a second portion having a bellows construction which unfolds when subjected to pressures in excess of the predetermined pressure thereby causing the first portion to move longitudinally outwardly.

5. A liquid spray dispenser as defined in claim 4 wherein the dispenser retention means includes:

an enclosure, having a diameter slightly larger than the diameter of the dispenser thereby forming passages for escaping gas and a retainer for the dispenser in case of rupture of the dispenser.

6. A liquid spray dispenser as defined in claim 5 further including a remote actuating member coupled to the control arm for moving the control arm inwardly, to engage the dispenser valve.

7. A liquid spray dispenser as defined in claim 6 wherein the remote actuating member includes a stop collar spaced from and coupled to the control arm to allow movement of said control arm independently of the remote actuating member.

8. The liquid spray dispenser apparatus as defined in claim 7 wherein:

the control arm includes a projection fixedly attached thereto; and the spray dispenser valve includes a finger tab coupled thereto, so that upon application of the predetermined force to the control arm the projection will engage the finger tab thereby activating the spray dispenser valve and so that when the first portion of the dispenser moves outwardly the finger tab will engage the projection thereby activating the spray dispenser valve.

9. A liquid spray dispenser apparatus as defined in claim 7 wherein:

the control arm includes a recessed opening formed therein; and the spray dispenser valve includes a cylindrical member aligned in the recessed opening in engagement with the control arm for activating the valve when the control arm is moved toward the valve and when portions of the dispenser are moved longitudinally to cause the valve to engage the control arm.

* * * * *